US007021125B2

(12) United States Patent
Focke et al.

(10) Patent No.: US 7,021,125 B2
(45) Date of Patent: Apr. 4, 2006

(54) PROCESS AND APPARATUS FOR CHECKING ROD-LIKE ARTICLES, IN PARTICULAR CIGARETTES

(75) Inventors: Heinz Focke, deceased, late of Verden (DE); by Jurgen Focke, legal representative, Verden (DE); by Doris Focke, legal representative, Verden (DE); Dietrich Below, Bülstedt (DE); Kurt Meyer, Kirchlinteln-Neddenaverbergen (DE)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

(21) Appl. No.: 10/700,059

(22) Filed: Nov. 4, 2003

(65) Prior Publication Data

US 2004/0148908 A1 Aug. 5, 2004

(30) Foreign Application Priority Data

Nov. 12, 2002 (DE) ..... 102 52 913

(51) Int. Cl.
*G01N 3/48* (2006.01)

(52) U.S. Cl. ..... 73/81

(58) Field of Classification Search ..... 73/818, 73/865.8, 78, 81
See application file for complete search history.

(56) References Cited

U.S. PATENT DOCUMENTS

| | | | | |
|---|---|---|---|---|
| 3,646,942 | A * | 3/1972 | Asbill et al. | 131/65 |
| 3,874,227 | A | 4/1975 | Focke | |
| 4,034,538 | A * | 7/1977 | Schmermund | 53/148 |
| 4,685,554 | A * | 8/1987 | Oberdorf | 198/468.6 |
| 4,733,673 | A * | 3/1988 | Mattei et al. | 131/84.1 |
| 4,856,538 | A * | 8/1989 | Focke et al. | 131/282 |
| 4,899,889 | A | 2/1990 | Gamberini et al. | |
| 5,113,879 | A * | 5/1992 | Alleon | 131/329 |
| 5,524,414 | A * | 6/1996 | Spada et al. | 53/54 |
| 6,508,138 | B1 * | 1/2003 | Focke et al. | 73/865.8 |

FOREIGN PATENT DOCUMENTS

| | | |
|---|---|---|
| CN | 1271677 | 11/2000 |
| DE | 2 311 084 | 9/1974 |
| DE | 29 18 030 | 11/1980 |
| DE | 37 33 955 A1 | 4/1988 |
| DE | 37 29 213 A1 | 3/1989 |
| DE | 199 19 207 A1 | 11/2000 |
| EP | 1 048 568 A1 | 11/2000 |
| FR | 1 122 720 | 9/1956 |
| GB | 1 271 375 | 7/1961 |
| GB | 2 196 311 | 4/1988 |

* cited by examiner

*Primary Examiner*—Max Noori
(74) *Attorney, Agent, or Firm*—Sughrue Mion, PLLC

(57) ABSTRACT

A process for checking rod-like articles, in particular cigarettes (12), and an apparatus which is suitable for carrying out the process, a moveable testing element (20), with mounted push rods (21) displaceable in the axial direction being moved in the direction of the articles, and each push rod (21) being displace as it strikes against an article and an electrically evaluable signal—actuating signal (31)—being generated as a result and, upon generation of the actuating signal (31), the position of the testing element (20) is determined, and the determined position is evaluated

21 Claims, 6 Drawing Sheets

PROCESS AND APPARATUS FOR CHECKING ROD-LIKE ARTICLES, IN PARTICULAR CIGARETTES

BACKGROUND OF THE INVENTION

The invention relates to a process and an apparatus for checking rod-like articles, in particular cigarettes, according to the respective preamble of the independent claims.

A process of the generic type and a corresponding apparatus are known from U.S. Pat. No. 6,508,138. The known process is not yet optimum because, in the case of checking formations of articles, with articles positioned incorrectly to a certain extent, e.g. skewed cigarettes, the formation was evaluated as correct overall. Furthermore, a change in the format—in the length—of the articles, up until now, required mechanical adaptation of the testing apparatus.

SUMMARY OF THE INVENTION

Accordingly, the object of the invention is to provide a testing process and a testing apparatus in the case of which the abovementioned disadvantages are avoided.

In order to achieve this object, the process according to the invention is characterized in that, upon generation of the actuating signal, the position of the testing element is determined and the determined position is evaluated. The object is also achieved by a corresponding apparatus according to the invention, which is characterized in that it is possible to determine the position of the testing element and to store and evaluate the determined position in response to the actuating signal.

BRIEF DESCRIPTION OF THE DRAWINGS

Further special features and details of the invention are explained in more detail hereinbelow with reference to an exemplary embodiment illustrated in the drawing, in which.

DETAILED DESCRIPTION OF THE INVENTION

Figure 1:
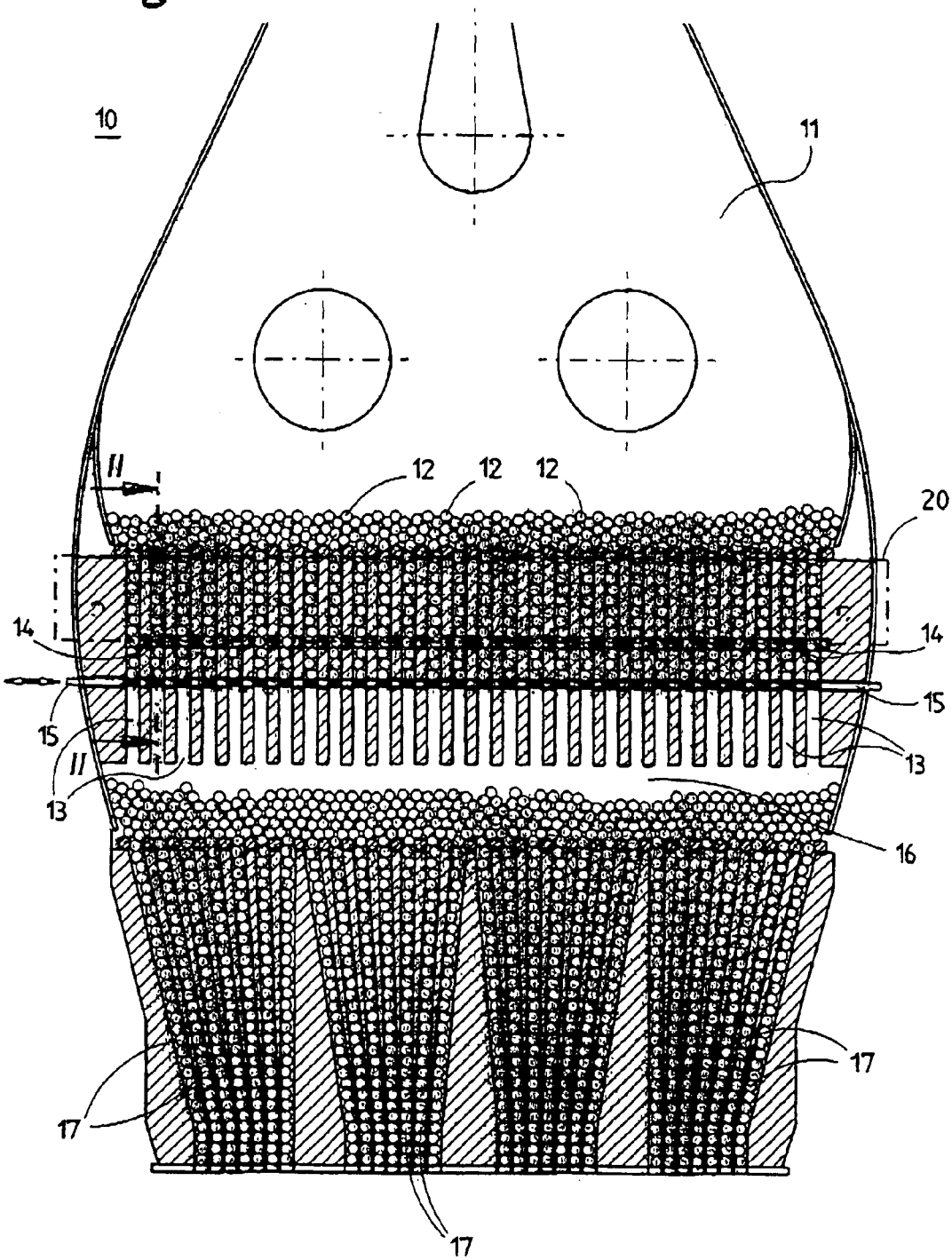
FIG. 1 shows, as an example of a packaging machine, a so-called soft-pack packaging machine for packaging cigarettes.

FIG. 1 shows a so-called soft-pack packaging machine as the packaging machine 10, and the cigarette feed there. A soft-pack packaging machine is known in general. It has a cigarette-feed shaft 11 in a top region. In its bottom region, as the articles which are to be packaged, a multiplicity of cigarettes 12 are illustrated, by the end or filter side which can be seen in plan view, as a circular contour. Provided in a central part of the soft-pack packaging machine is a multiplicity of testing shafts 13, through which the individual cigarettes 12 pass, one after the other in each case, under the influence of gravity. Each testing shaft 13 is assigned a pressure-exerting slide 14 and a blocking slide 15. The pressure-exerting slide 14 is provided for pressing in each case at least one cigarette 12 onto a wall of the testing shaft 13. If a cigarette 12 is secured by the pressure-exerting slide 14 in this way, the cigarettes 12 which are located above the secured cigarettes 12 no longer move, with the result that these are located in a defined position for subsequent testing. The blocking slide 15 is provided in order to block all the testing shafts 13. When the blocking slide 15 is actuated, all the cigarettes 12 which are located above the blocking slide 15 are secured. Following the testing shafts 13, the tested cigarettes 12 pass into a collecting region 16, from which—once again under the influence of gravity—they pass into individual cigarette shafts 17.

Figure 2:
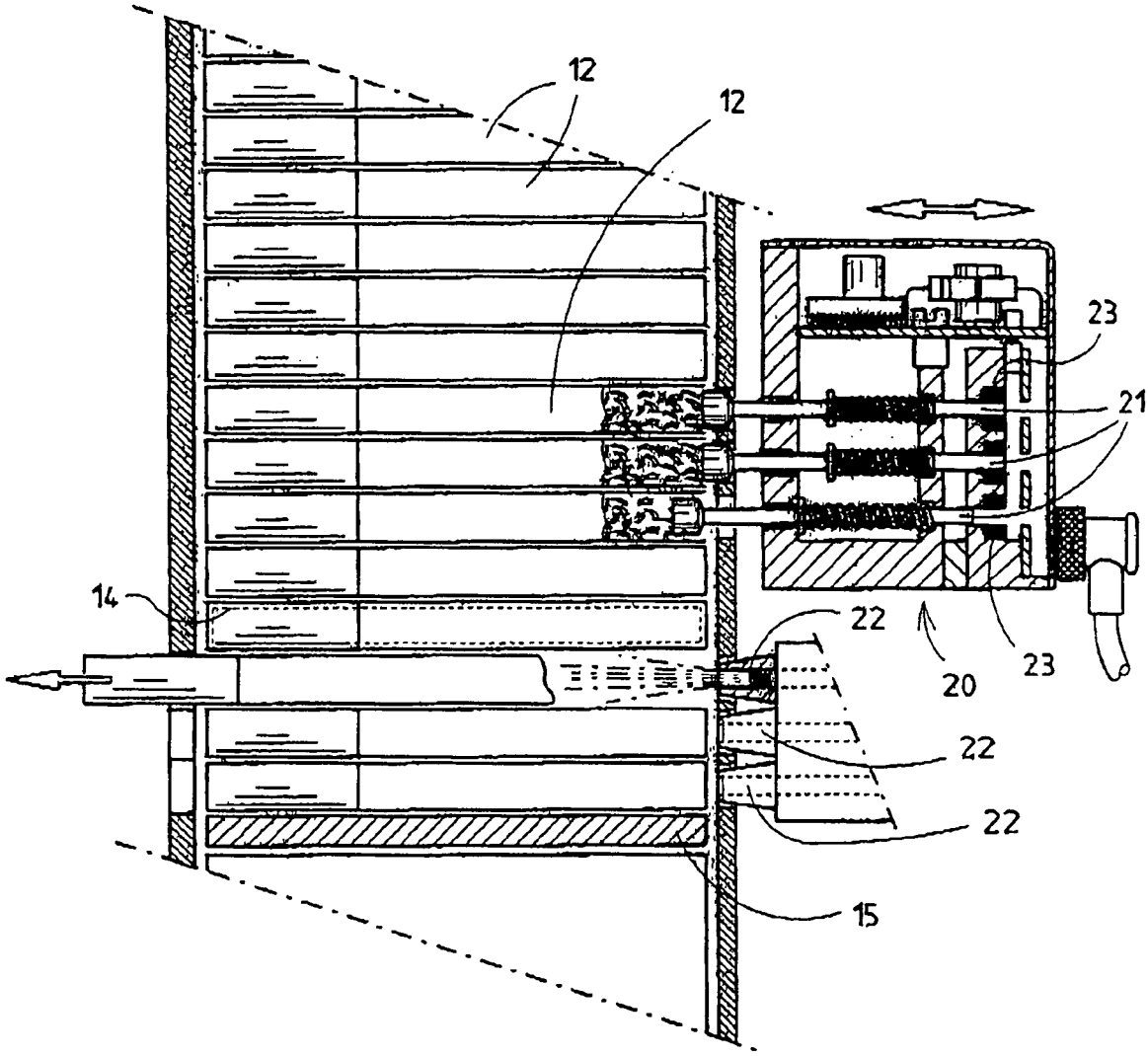
FIG. 2 shows a section through the soft-pack packaging machine.

FIG. 2 shows a section through the soft-pack packaging machine along line II—II (FIG. 1) through one of the testing shafts 13, with the result that the interior of this testing shaft 13 is illustrated with the cigarettes 12 contained therein. Provided upstream of the soft-pack packaging machine is a moveable testing element 20 with a number of push rods 21 for testing the tobacco end sides of the cigarettes 12. The testing element comprises a housing, through which the push rods 21 project outwards. A guide for the push rods 21 is provided within the housing. Also provided within the housing are means 23, e.g. an induction coil, for triggering an actuating signal when the push rod 21 is deflected (i.e., displaced), and also electronics for storing or processing, and then transmitting the or each actuating signal. The testing element 20 is depicted in FIG. 1 by the chain-dotted contour in front of the individual testing shafts 13, above the respective pressure-exerting slides 14. The testing element 20 executes an oscillating movement (i.e., displacement or deflection), with the result that it moves towards the cigarettes 12 (forward movement) and, in the process, the ends of the push rods 21 strike against the end sides of the cigarettes 12, as a result of which the push rods 21 are deflected (displaced). Following this testing, the testing element 20 moves away from the cigarettes 12 again (rearward movement), with the result that the cigarettes 12 are released again. The forward and rearward movement (displacement or deflection) of the testing element 20 is illustrated by the double arrow. During the forward movement of the testing element the cigarettes 12 are pressed against a rear wall of the testing shaft 13, thus resulting in a defined position for all simultaneously checked cigarettes 12.

If a push rod 21 strikes against a cigarette 12 during the forward movement (displacement or deflection, of the checking element 20 and is deflected (displaced) by a certain distance in the process, an electrically detectable signal (the actuating signal) is generated for this push rod 21. Details regarding the generation of the actuating signal can be gathered from U.S. Pat. No. 6,508,138, filed for the same applicant. If a cigarette 12 has not been completely filled with tobacco, the push rod 21 which strikes against this cigarette 12 is deflected (displaced) at a later stage, i.e. at a different position of the testing element 20, than a push rod 21 which strikes against an ordinary cigarette. Correspondingly, in such a case, the actuating signal is then also triggered at a later stage, i.e. at a different position of the testing element 20.

In order that the cigarettes 12 in the respective testing shaft 13 are located in a defined position during the testing operation, that is to say during the forward movement of the testing element 20, it is provided that beneath the cigarettes 12 which are to be tested in each case, as seen in the direction of flow, at least one cigarette 12 is secured in the testing shaft 13 by the pressure-exerting slide 14. The pressure-exerting slide 14 is illustrated in FIG. 2 as a dashed contour concealed by the pressed-on cigarette 12. The cigarette 12 in front of the pressure-exerting slide 14 is secured during the testing operation by being pressed onto the wall of the testing shaft 13. The blocking slide 15 is located beneath the position of the pressure-exerting slide 14, as seen in the direction of flow of the cigarettes 12. Between the pressure-exerting slide 14 and blocking slide 15, there is space for precisely as many cigarettes as the testing element 20 has push rods 21 for in each case one testing shaft 13. In the exemplary embodiment, there is space for precisely three cigarettes 12 between the pressure-exerting slide 14, or the cigarettes 12 which it presses, and the blocking slide 15, since the testing element 20 has precisely three push rods 21 for each testing shaft 13. If, during testing of the cigarettes 12, the defectiveness of one or more tested cigarettes 12 has been established, the defective cigarettes 12 are ejected by ejecting elements, namely compressed-air nozzles 22. The rear wall of the testing shaft 13 is open at this location, with the result that defective cigarettes 12 are completely removed from the testing shaft 13. In the process, the pressure-exerting slide 14 and blocking slide 15 are actuated alternately. In other words, when the pressure-exerting slide 14 clears the checking shaft 13, the latter is blocked by the blocking slide 15, with the result than only a defined number of cigarettes 12 advance in the checking shaft 13. If the blocking slide 15 clears the checking shaft 13, the pressure-exerting slide 14 is then activated so that only the cigarettes 12 in the section between the pressure-exerting slide 14 and the blocking slide 15 drop in the checking shaft 13. The space between the pressure-exerting slide 14 and the blocking slide 15 should therefore be particularly dimensioned to accommodate the precise number of cigarettes 12 checked in a single checking run made by the checking element 20.

Figure 3A:
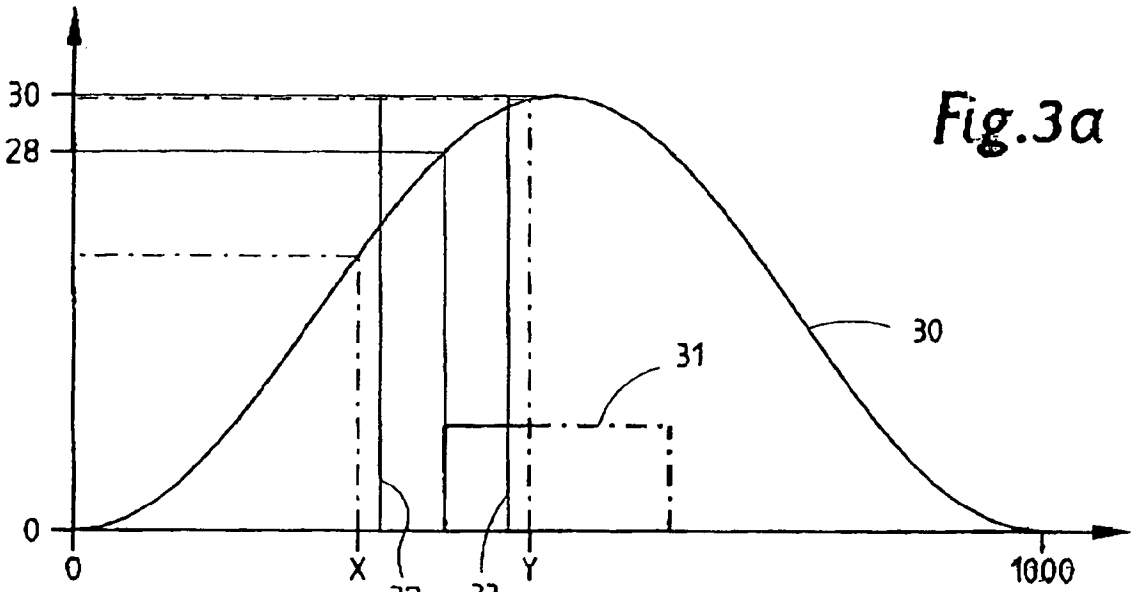
FIG. 3*a* shows a displacement distance of the testing element with an actuating signal supplied by a push rod of the testing element.

FIG. 3*a* shows a displacement distance 30 of the testing element 20 plotted in a coordinate system. In the coordinate system, the deflection of the testing element 20 is plotted on the y-axis and a time base is plotted on the x-axis. The time base used is preferably a time base which is geared to the operating speed of the packaging machine 10. For this purpose, it is customary to use, for example, a full revolution of a main spindle assigned, in particular, to the packaging machine 10. For this purpose, the revolution of the main spindle is measured by an incremental encoder or angle sensor. A certain number of counting pulses, here for example 1000, corresponds to a full revolution of the main spindle. With reference to the illustrated displacement distance 30 of the testing element 20, it can be seen that the testing element 20 has executed a complete forward movement and a complete rearward movement during a full revolution of the main spindle. The illustrated displacement distance 30 of the testing element 20 over the time base is in the form of a half-wave of a sinusoidal oscillation, as is customary in the case of such oscillating movements. Likewise illustrated is the actuating signal 31 of a push rod 21 which, as a binary signal (actuated/not actuated), is rectangular. As soon as the actuating signal 31 for a push rod 21 is produced, the current position of the testing element 20 is established. It is immaterial here as to whether the position of the testing element 20 is depicted in the form of the existing deflection or in the form of the counting pulses elapsed, since both form a constant relation over a displacement distance 30 of the testing element 20 during a full revolution of the central spindle.

FIG. 3*a* illustrates the case where the actuating signal 31 is produced before a maximum deflection of the testing element 20 during the forward movement by, for example, thirty distance units, namely at twenty-eight distance units. One of the push rods 21 thus strikes against the tobacco end side of a cigarette 12 and is consequently deflected such that the actuating signal 31 is triggered before the testing element 20 has completed the forward movement. If one of the push rods 21 were to strike against a cigarette 12 at a considerably earlier stage during the forward movement of the testing element 20, the beginning of the actuating signal 31 shifts to the left on the y-axis. Earlier triggering of the actuating signal 31 may be caused by a cigarette 12 which is too long. If the cigarette 12, by contrast, is too short or has not been filled with sufficient tobacco, the beginning of the actuating signal 31 correspondingly shifts to the right on the y-axis.

Two limit values 32, 33 are used in order to evaluate the actuating signal 31, in which case, with an actuating signal 31 generated within these limit values 32, 33, the respective cigarette 12 is evaluated as still being defect-free, and a cigarette 12 which has triggered an actuating signal 31 outside these limit values 32, 33 is evaluated as defective, with the result that an error signal is generated correspondingly.

Figure 3B:
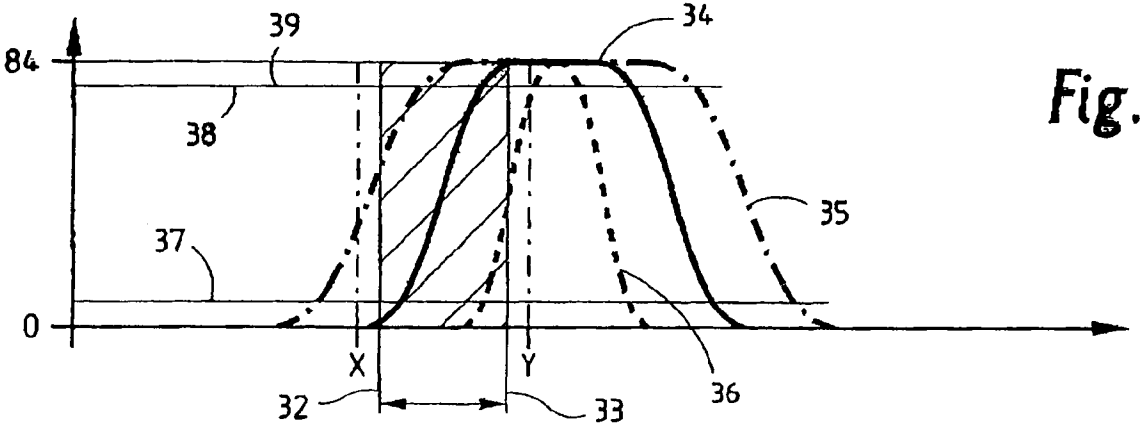
FIG. 3*b* shows examples of exemplary cumulative frequency curves which are determined over time with all the actuating signals being added.

The individual evaluation of all the actuating signals 31, in the case of a multiplicity of testing shafts 13 and the plurality of cigarettes 12 which are checked in each testing shaft 13 during a testing operation, is only practicable to a certain extent. In actual fact, in the exemplary embodiment illustrated with twenty-eight testing shafts (FIG. 1) and in each case three cigarettes 12 tested in a testing shaft 13 during a testing operation (FIG. 2), eighty-four actuating signals 31 would have to be checked. It is thus preferably provided that the actuating signals 31 are added over the time base and a resultant cumulative frequency curve 34, 35, 36 is evaluated rather than the individual actuating signals 31. FIG. 3*b* illustrates a plurality of such cumulative frequency curves 34, 35, 36. Each cumulative frequency curve 34, 35, 36 begins, during the forward movement of the testing element 20, at a zero height because, in the first instance, none of the push rods 21 is deflected and, correspondingly, no actuating signal 31 is produced. Each cumulative frequency curve 34, 35, 36 correspondingly terminates at the zero height because, at some point during the rearward movement of the testing element 20, a position is reached at which, once again, none of the push rods 21 is deflected, so that, correspondingly, no actuating signal 31 is produced. Furthermore, each cumulative frequency curve 34, 35, 36 reaches a maximum at the turning point of the movement of the testing element 20 because, at this location, all the push rods 21, or at least most of the push rods 21, are deflected and a corresponding number of actuating signals 31 is thus produced. If all the push rods 21 are deflected at this position, eighty-four actuating signals 31 are correspondingly produced for eighty-four push rods 21, with the result that the cumulative frequency curve 34, 35, 36 has a height of eighty-four units.

Depending on whether the cigarettes 12, by way of a uniform format or by way of a uniform tobacco filling, are approximately the same length, the push rods 21 are deflected in close temporal succession. A first method of checking the cumulative frequency curve 34, 35, 36 is to check the duration of the rise starting from a first threshold value as start value 37, in particular zero, up to a second threshold value as maximum value 38 in respect of the respective position of the testing element 20 when the start value 37 and maximum value 38 are reached. In the case which is illustrated in FIG. 3*b*, it is only the rise of the cumulative frequency curve 34 from the start value 37 up to the maximum value 38, said curve being illustrated by solid lines, which takes place within the two limit values 32, 33 for the position of the testing element 20. In the case of the cumulative frequency curve 35 which is illustrated by chain-dotted lines, although the maximum value 38 is reached within the interval predetermined by the limit values 32, 33, the start value 37 is reached before the interval, which indicates that some push rods 21 have been deflected "too early", with the result that, among the tested cigarettes 12, at least some of the cigarettes 12 were longer than expected or envisaged. In the case of the cumulative frequency curve 36 which is illustrated by dashed lines, it is only the start value 37 which is reached within the interval defined by the limit values 32, 33, while the maximum value 38 is only reached outside the interval. This indicates that a multiplicity of the push rods 21 have been deflected "at a relatively late stage" during the forward movement of the testing element 20, with the result that, among the cigarettes 12 tested, there are a considerable number of cigarettes 12 which are either too short or have not been filled with sufficient tobacco. It is sufficient to carry out the evaluation only during the forward movement of the testing element 20 because corresponding conditions are present during the rearward movement and the profile both of an individual actuating signal 31 and of a cumulative frequency curve 34, 35, 36 is symmetrical to the displacement distance 30 of the testing element 20. Furthermore, it is sufficient for the evaluation also to be carried out merely over certain parts of the forward movement of the testing element 20. In the illustrations, the positions X and Y respectively designate the beginning and the end of the evaluation. The interval which is defined by the abovementioned limit values 32, 33 is illustrated as a hatched region in FIG. 3*b*. In order to adapt the checking process to cigarettes of differing lengths, for example, after a change of product or brand, a shift in the evaluation section delimited by the X and Y positions is sufficient. When checking cigarettes that are longer on the whole, the push rod 21 is namely deflected at an earlier point in time, thus "farther to the left" in FIG. 3*b*, resulting in an overall widening of cumulative frequency curve 34, 35, 36. When checking cigarettes that are on the whole shorter, the push rod 21 is deflected at a correspondingly later point in time, i.e. "farther to the right" in FIG. 3*b*, resulting in an overall narrowing of the cumulative frequency curve 34, 35, 36.

An alternative possibility for checking the cumulative frequency curve 34, 35, 36 is to check the duration over which the respective cumulative frequency curve 34, 35, 36 exceeds a threshold value 39. In this case, the number of time units during which the respective cumulative frequency curve 34, 35, 36 runs above the threshold value 39 are counted. The cumulative frequency curve 35, which is illustrated by chain-dotted lines, runs above the threshold value 39 for the longest period of time. It has already been explained above that a cumulative frequency curve of the type 35 which is illustrated by chain-dotted lines is established when, among the cigarettes 12 tested, a multiplicity of the cigarettes 12 are too long. In contrast, the cumulative frequency curve 36, which is illustrated by dashed lines, only runs above the threshold value 39 for a short period of time. In this respect, it has already been explained above that such a cumulative frequency curve 36 is established when, among the cigarettes 12 tested, many of the cigarettes were too short or only filled with insufficient tobacco.

In order to evaluate the cumulative frequency curves 34, 35, 36, a lower and an upper temporal threshold value are introduced, the lower temporal threshold value being selected such that the duration over which the cumulative frequency curve 36, which is illustrated by dashed lines, exceeds the threshold value 39 falls below this temporal threshold value and the duration over which the cumulative frequency curve 35, which is illustrated by chain-dotted lines, exceeds the threshold value 39 rises above this temporal threshold value. Correspondingly, the duration over which the cumulative frequency curve 34, which is illustrated by solid lines, exceeds the threshold value 39 comes between these lower and upper temporal threshold values, with the result that this cumulative frequency curve 34 can be evaluated to the effect that the cigarettes 12 tested fulfill the requirements.

Figure 4:
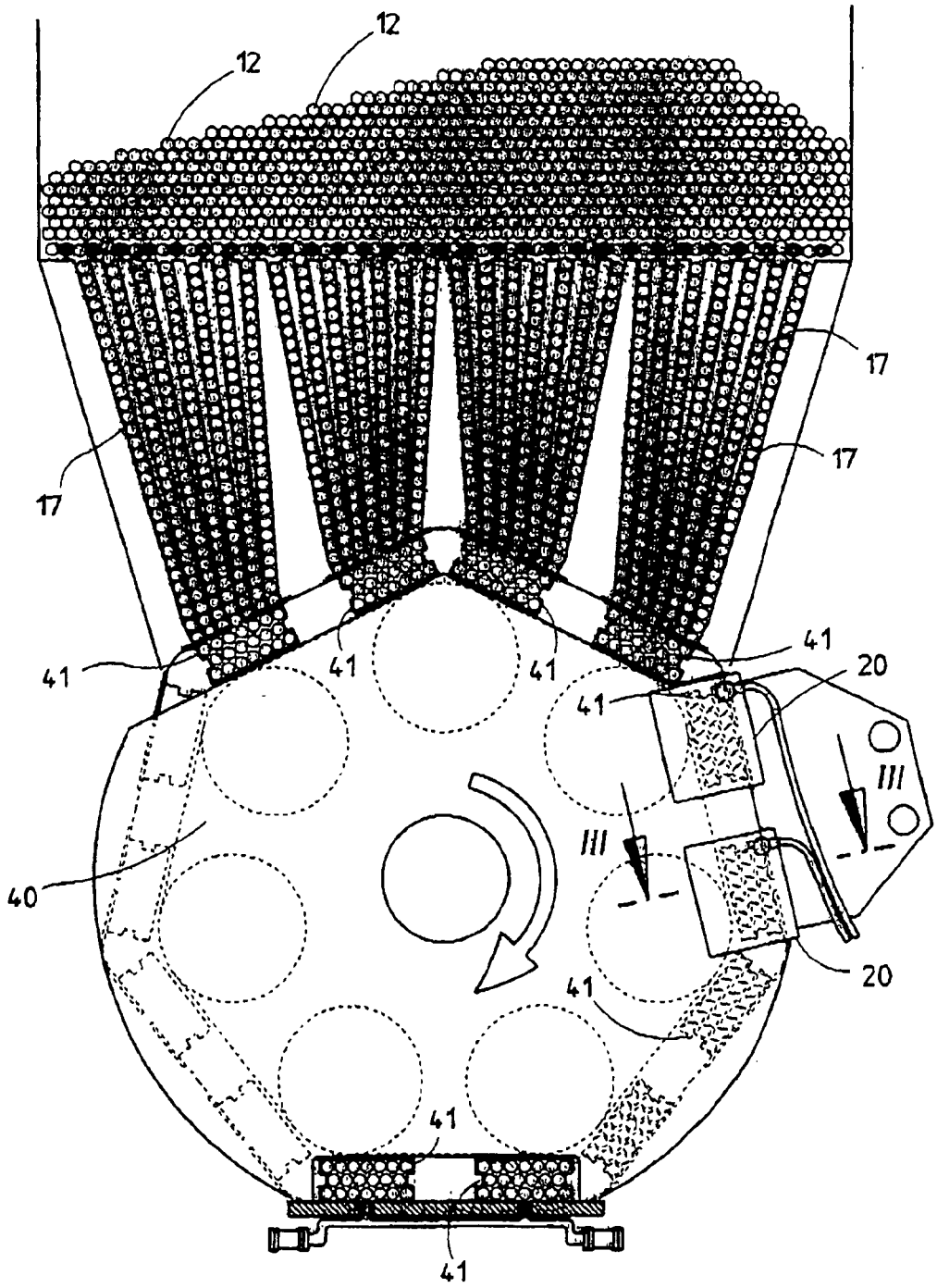
FIG. 4 shows a further use example of the invention in a cigarette turret.
Figure 6:
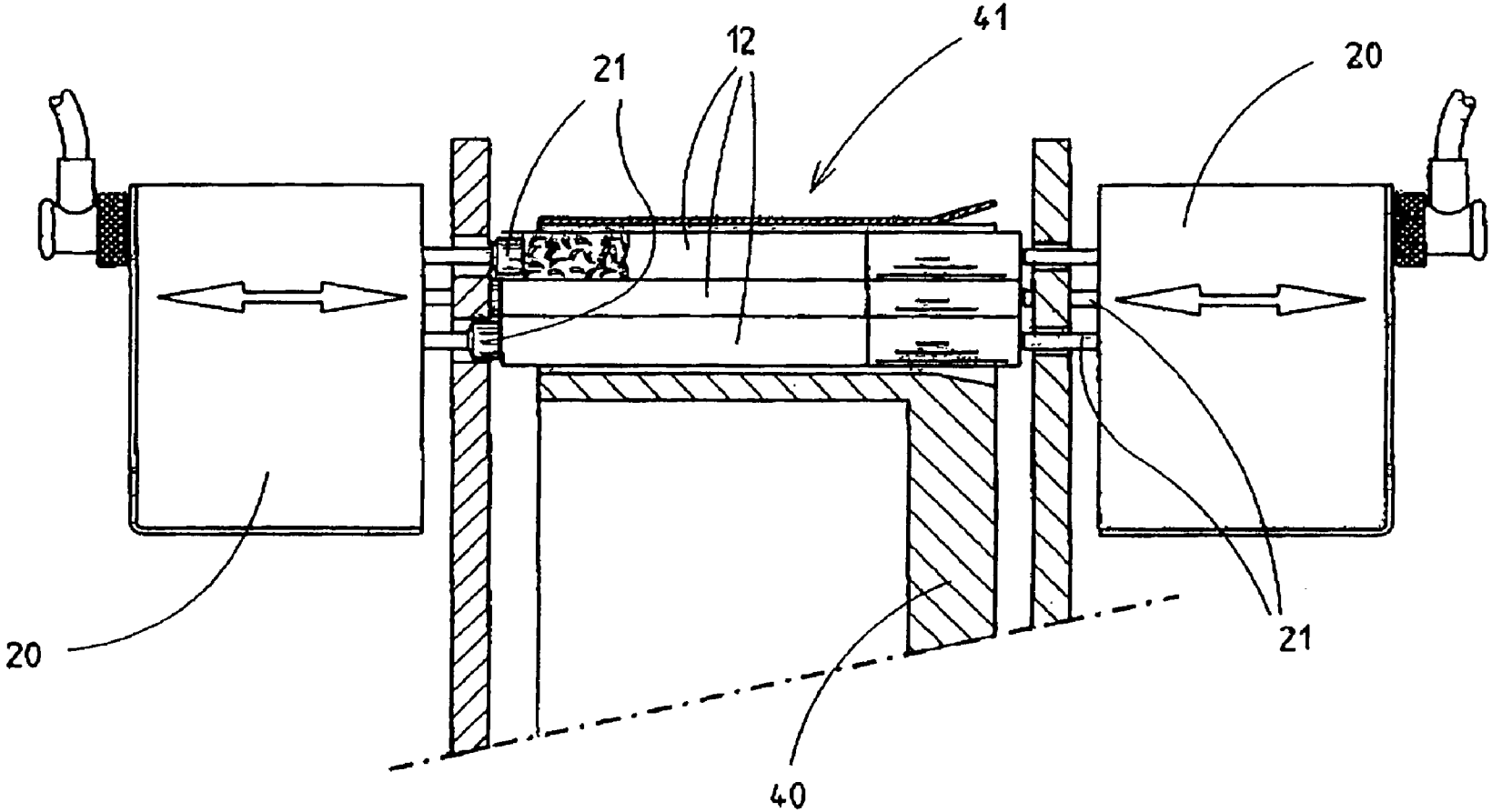
FIG. 6 shows a section through the cigarette turret.

In a practical configuration, the respective cumulative frequency curve 34, 35, 36 can be checked as follows: each push rod 21, in a memory of a processing unit, is assigned precisely one memory cell (not all are illustrated), the respective memory cell representing the value of the respective actuating signal 31. That is to say, with the actuating signal 31 triggered, the respective memory cell has a value of "logical one". A plurality of memory cells here are combined into groups. It is usually the case that eight memory cells are combined, in a manner which is known per se, into a group to form one byte. In the case of eighty-four push rods 21, in order to represent the respective states, it is thus the case that ten bytes (=eighty memory cells) and four further memory cells are necessary. These four further memory cells are completed by four additional memory cells, which are set to "logical one" as standard, to form a further byte. During the movement of the testing element 20 or a selected part of this movement, these eleven bytes are permanently subjected to a logical AND operation and the consequent logic result is evaluated. As long as one of the push rods 21 has not been deflected to the extent where the corresponding actuating signal 31 is generated, a "logical zero" also remains in the logic result. It is only when all the push rods 21 have been deflected that all the associated memory cells have the value "logical one", so that it is also only the "logical one" which appears in the logic result. When the logic result contains only logic ones for the first time, the position of the testing element 20 is established. An equivalent result is achieved by establishing the point in time along the time base at which this arrangement occurs. As soon as one of the push rods 21 is released again during the rearward movement of the testing element 20, the corresponding actuating signal 31 disappears, as does thus the "logical one" state in the associated memory cell. Correspondingly, it is now also the case that the logic result no longer has just "logical ones"; rather, at least one "logical zero" is present. It is also the case when this situation arises that the position of the testing element 20 or the associated point in time is established. If the first position/the first point in time determined in this way or both the positions/points in time determined or the difference between these positions/points in time are located within predetermined limit or threshold values, the cumulative frequency curve 34, 35, 36 is one in which the cigarettes 12 tested satisfy predetermined criteria. However, if the period of time or the distance covered by the testing element 20 between these two positions/points in time determined is too great (cumulative frequency curve 35) or too small (cumulative frequency curve 36), the situation detected is one in which at least one of the cigarettes 12 tested does not correspond to the preset requirements. A check of the time profile of the individual actuating signals 31, which is stored at least in part for this purpose, is then carried out in order to determine which push rod 21 was, or which of the push rods 21 were, deflected too early, too late or at too long or too short a distance, in order then to determine which cigarettes 12 are defective. Cigarettes 12 which are detected as being defective are ejected by means of the compressed-air nozzles 22. It may be provided that, in the case of at least one cigarette 12 within a cigarette shaft 13 being detected as being defective, all the cigarettes 12 which are secured between the pressure-exerting slide 14 and the blocking slide 15 are ejected. The processing unit, referred to but not shown, is a control unit or the like. That or each testing element 20 is connected with the processing unit in a known fashion, e.g. via the cable connections of the respective testing element 20 as shown in FIG. 2, FIG. 4 and FIG. 6, so that the respective actuation signals can be transmitted on to the processing unit. For evaluating the position of a testing element 20 the processing unit processes the position data which are sent from the incremental encoder or angle sensor.

FIG. 4 illustrates a further application of the invention. A cigarette turret 40 which is known per se is provided in order to package the cigarettes 12 in cigarette packs. This turret comprises individual pockets 41, in which the cigarettes 12 are located in the conventional three-layered formation. The cigarettes 12 are received from the cigarette shafts 17 into the pockets 41 (in the top region of the cigarette turret 14 in the illustration) and, after a corresponding rotation of the cigarette turret 40, are transferred out of the pockets 41, for further handling, to following devices, which are not illustrated (in the bottom region of the cigarette turret 40 in the illustration). Between these two positions, monitoring takes place, on the one hand, of the filter ends and, on the other hand, of the tobacco ends of the respective cigarette formation in a pocket 41 in accordance with the principle described above. For this purpose the cigarette formation is secured against undesired shifting along the longitudinal axis of the pocket 41 by a spring steel plate or the like. Provided for the purpose of inspecting the cigarette formation are two mutually opposed testing elements 20 which basically corresponds to the respective testing element 20 already illustrated in FIG. 2, but, in respect of the number and position of the respective push rods 21, are geared to the formation of the cigarettes 12 in a pocket 41. Both testing elements 20 also execute an oscillating movement, with the result that, during a forward movement, a push rod 21 which strikes against a cigarette 12 is deflected and an associated actuating signal 31 is generated.

The cigarette turret 40 is moved cyclically. In each case two pockets 41 are always located in the region of two front and rear testing elements 20. The rear testing elements 20 are not visible in the illustration in FIG. 4 due to their position behind the cigarette turret 40. They are provided for monitoring the filter side of the respective cigarette formation. The front testing elements 20 are correspondingly provided for monitoring the tobacco side of the respective cigarette formation. The front and rear testing elements 20 are shown in FIG. 6 of the section view along line III—III from FIG. 4. Each pair of testing elements 20 executes an oscillating movement. For this purpose each pair of testing elements 20 is mounted on a common support, such as a plate or the like. The oscillating movement of these testing elements 20 corresponds to the movement which has already been illustrated in FIG. 3*a*. The oscillating movement of the respective opposing testing elements 20 is executed such that the respective pair of opposing testing elements 20 are moved simultaneously and equidirectionally to the cigarette formation located in the pocket 41. At the end of the simultaneous forward movement, the two opposing testing elements also move simultaneously and equidirectionally away from the cigarette formation. The pocket is open at both sides for this purpose so that the pushrods 21 of the opposing testing elements 20 can reach the cigarettes 21 located in the pocket 41.

Figure 5:
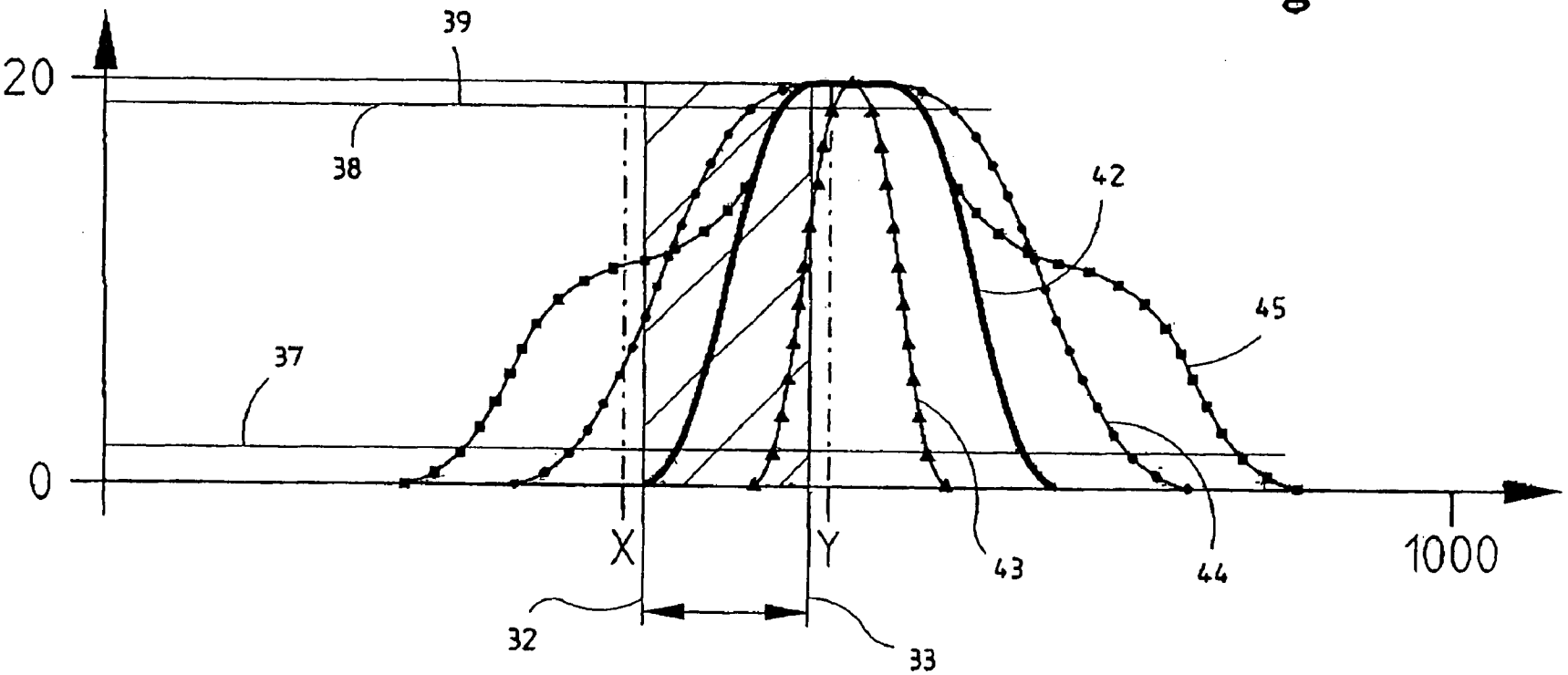
FIG. 5 shows further examples of exemplary cumulative frequency curves.

The individual actuating signals 31 detected for each testing element 20 are added to give cumulative frequency curves 42, 43, 44, 45, as is illustrated in FIG. 5. In comparison with FIG. 3*b*, the height of the respective cumulative frequency curve 42–45 is nevertheless lower since, in the case of twenty cigarettes 12 in a cigarette formation, a maximum of twenty actuating signals 31 are triggered by the associated twenty push rods 21 of the respective testing element 20 and the respective cumulative frequency curve 42–45 thus has a maximum height of twenty units. The check of the cumulative frequency curves 42–46 in respect of exceeding or dropping below certain start, maximum and threshold values 37, 38, 39, e.g. within an interval defined by limit values 32, 33, corresponds to the check which has already been described with reference to FIG. 3*b*. Accordingly, an excessively narrow cumulative frequency curve, e.g. the cumulative frequency curve 43 identified by triangles, indicates a cigarette formation with cigarettes 12 which are too short, and an excessively wide cumulative frequency curve, e.g. the cumulative frequency curve 44 identified by circle symbols, indicates a cigarette formation with cigarettes 12 which are too long. A cigarette formation with cigarettes 12 which satisfy the predetermined criteria has a cumulative frequency curve with a rapid rise, which, in respect of width, lies between the two cumulative frequency curves 43, 44 which indicate a defective cigarette formation, that is to say, for example, a cumulative frequency curve 42, as is illustrated by solid lines in FIG. 5. FIG. 5 also illustrates a cumulative frequency curve 45 which is identified by square symbols and is produced, for example, if, in a cigarette formation, one cigarette 12 is skewed in particular in front of the end sides of the other cigarettes 12, that is to say, for example, a cigarette which has been introduced only part of the way and then broken off. In this case, a large number of push rods 21 of the respective testing element 20 strike against the broken cigarette at a relatively early stage, thus giving rise to the illustrated expansion of the cumulative frequency curve 45. Using the shape of the cumulative frequency curve 45, it is thus also possible to draw conclusions about the defect present in each case.

Likewise, it is possible to record the moment of pushrod abutment releasing the actuating signals of the individual pushrods 21 and to set it in relation to the moment of pushrod abutment releasing the actuating signals of the pushrod 21 of the opposing testing element 20. Thus, the opposite testing elements 20 record the actuation signals of those pushrods 21 which contact the same cigarette 12 at the front as well as at the tobacco end. Based on the recorded moment of abutment of these actuating signals, position information can be deduced using the displacement distance 30 of the respective testing element 20. Information about the length of the respective cigarette 12 can be deduced from the recorded moments for each cigarette 12 of the cigarette formation or from the deducible position information in conjunction with the known distance of the opposing testing elements 20 in a resting position, i.e. in a non-extended state. This deduction, i.e. the calculation of the necessary mathematical or logic operations, are performed by the aforementioned processing unit. The necessary instruction are programmed in the software of the processing unit or implemented in the hardware. If the determined length of the respective cigarette 12 lies within the preset or specified range, the respective cigarette 12 is evaluated as normal. If the determined lengths of all cigarettes 12 of a cigarette formation lie within the range, the entire cigarette formation is evaluated as normal. The cigarette formation can then—in known fashion—be put into a cigarette pack in the further course of the packaging process. By varying the specified or preset range the testing can be reset at any time for new cigarette lengths.

If a faulty cigarette length is detected for at least one cigarette 12 of the cigarette formation, an index for tracking this cigarette information is established for the further packaging process. At an appropriate time, the cigarette formation, which may be located in a finished or semi-finished cigarette pack, can be removed from the process.

The invention claimed is:

1. Process for checking rod-like articles, in particular cigarettes (12), by means of at least one push rod (21) which is mounted in an axially displaceable manner in a moveable testing element (20), the or each testing element (20) being moved in the direction of the articles and the or each push rod (21) being displaced as it strikes against an article and an electrically evaluable signal—actuating signal (31)—being generated as a result, characterized in that, upon generation of the actuating signal (31), the position of the testing element (20) is determined and the determined position is evaluated, wherein in the case of a plurality of push rods (21) for each actuating signal (31) triggered by in each case one push rod (21), the respective position of the testing element (20) is determined.

2. Process according to claim 1, characterized in that the position of the testing element (20) is determined in respect of a position of a machine for packaging the articles —packaging machine (10)—in which the articles are guided and which is assigned the testing element (20).

3. Process according to claim 2, characterized in that the position of the packaging machine (10) is determined in a number of counting pulses relating to a full revolution of a central spindle assigned to the packaging machine (10).

4. Process according to claims 1, characterized in that an error signal is generated if the position of the testing element (20), upon generation of the actuating signal (31), is located outside predeterminable limit values (32, 33).

5. Process according to claim 1, characterized in that that in each case a group of items, namely a cigarette formation, is assigned two testing elements (20) each on opposite sides and that both testing elements (20) move simultaneously.

6. Process according to claim 5, characterized in that that each time a pushrod (21) of one of the two testing elements (20) contacts an article the respective position of the testing element (20) is recorded and that for opposing pushrods (21) the respectively determined positions are used to deduce information concerning the length of the articles.

7. Process according to claim 6, characterized in that that the length information is compared with a predetermined or predeterminable reference value or reference value range in order to identify articles that are too long or too short—"faulty articles".

8. Process according to claim 1, characterized in that, in the case of a plurality of push rods (21), the corresponding plurality of actuating signals (31) is added and a resultant cumulative frequency curve (34, 35, 36; 42, 43, 44, 45) is checked for the value exceeding or dropping below the threshold values (37, 38, 39) in respect to the relative position of the testing element (20) when the value exceeds or drops below the threshold values (37, 38, 39), or for the duration of the rise starting from a start value (37) to a maximum value (38), and the error signal is generated in dependence on this check.

9. Process according to claim 1, characterized in that the articles pass through a testing shaft (13) under the influence of gravity, and in that at least one of the articles is temporarily pressed onto a wall of the testing shaft (13) by a pressure-exerting slide (14), with the result that the articles which remain above the or each pressed-on article are located in a defined position during testing by the push rod (21) or the respective push rods (21).

10. Process according to claim 9, characterized in that the flow of articles through the testing shaft (13) is temporarily interrupted by means of a blocking slide (15), which is arranged beneath the pressure-exerting slide (14), as seen in the direction of flow of the articles, and is provided for temporarily blocking the testing shaft (13), and, in dependence on the error signal, one or more ejecting elements are, namely at least one compressed-air nozzle (22) is, activated for ejecting individual articles or all the articles located between the pressure-exerting slide (14) and blocking slide (15).

11. Process according to claim 1, characterized in that a plurality of articles—cigarette formation—are located in a pocket (41), open at both sides, of a cigarette turret (40), that due to the rotation of the cigarette turret (40) the pocket (41) is placed in the region of two mutually opposing testing elements (20) located laterally to the cigarette turret (40), that the rotation of the cigarette turret (40) is stopped when the region of the testing elements (20) is reached, that the two opposing testing elements (20) move toward the cigarette formation simultaneously and at the same time the pushrods (21) of the testing elements (20) enter the open ends of the pocket (41) and are displaced upon striking one of the articles.

12. Apparatus for checking rod-like articles, in particular cigarettes (12), having at least one push rod (21) which is mounted in an axially displaceable manner in a moveable testing element (20), the or each testing element (20) being moveable in the direction of the articles and the or each push rod (21) being displaceable as it strikes against an article, such that an electrically evaluable signal—actuating signal (31)—can be generated as a result, characterized in that it is possible to determine the position of the testing element (20) and to store or process the determined position in reaction to the actuating signal (31), with provision being made for storing or processing the respective position of the testing element (20).

13. Apparatus according to claim 12, characterized in that provision is made for storing or processing the position of the testing element (20) with respect to a position of a machine, in particular of a machine for packaging the articles—packaging machine (10)—in which the articles are guided and which is assigned the testing element (20).

14. Apparatus according claim 13, characterized in that that provision is made for storing or processing the position of the packaging machine (10) in a number of counting pulses relating to a full revolution of a central spindle assigned, in particular, to the packaging machine (10).

15. Apparatus according to claim 14, characterized in that provision is made for generating an error signal if the position of the testing element (20), upon generation of the actuating signal (31), is located outside predeterminable limit values (32, 33).

16. Apparatus according to claim 12, characterized in that that in each case a group of articles, namely a cigarette formation, is assigned two testing elements (20) each on opposite sides and that both testing elements (20) move simultaneously.

17. Apparatus according to claim 16, characterized in that a processing unit is provided for measuring the respective position of the checking unit (20) based on the impact of each pushrod (21) of one of the two opposing testing elements (20) on an article and for deducing information on the length of the article on the basis of the position determined for the opposing pushrods (21) of the opposite checking unit (20).

18. Apparatus according to claim 17, characterized in that the processing unit for comparing the length information is provided with a predetermined or predeterminable reference value or reference value range in order to identify articles which are too long or too short—faulty articles.

19. Apparatus according to claim 12, characterized in that a processing unit which is provided, in the case of a plurality of push rods (21), for adding the corresponding plurality of actuating signals (31) and for checking a resultant cumulative frequency curve (34, 35, 36; 42, 43, 44, 45) either for the value exceeding or dropping below threshold values (37, 38, 39) in terms of the respective position of the testing element (20) when the value exceeds or drops below the threshold values (37, 38, 39), or for the duration of the rise starting from a start value (37) to a maximum value (38).

20. Apparatus according to claim 13, characterized by a testing shaft (13), through which the articles pass under the influence of gravity, and by a pressure-exerting slide (14), which is provided for pressing at least one of the articles onto a wall of the testing shaft (13), with the result that the articles which remain above the or each pressed article are located in a defined position during testing by the respective push rod (21).

21. Apparatus according to claim 20, characterized in that provided in the testing shaft (13) beneath the pressure-exerting slide (14), as seen in the direction of flow of the articles, is a blocking slide (15) for temporarily blocking the testing shaft (13), and provided along a section between the pressure-exerting slide (14) and blocking slide (15) are one or more ejecting elements, in particular at least one compressed-air nozzle (22), for ejecting individual articles or all the articles located between the pressure-exerting slide (14) and blocking slide (15).

* * * * *